US008833582B1

(12) United States Patent
Ellis et al.

(10) Patent No.: US 8,833,582 B1
(45) Date of Patent: Sep. 16, 2014

(54) COLLECTIVE VERTICAL HYDRAULIC TANK WITH ADJUSTABLE FOOTPRINT

(71) Applicants: Stan Ellis, Bakersfield, CA (US); Travis Ellis, Bakersfield, CA (US)

(72) Inventors: Stan Ellis, Bakersfield, CA (US); Travis Ellis, Bakersfield, CA (US)

(73) Assignee: Vertical Tank, Inc., Bakersfield ( * ) Notice: Subject to any disclaimer, the term of this patent is extended or adjusted under 35 U.S.C. 154(b) by 0 days.

(21) Appl. No.: 13/673,855

(22) Filed: Nov. 9, 2012

(51) Int. Cl.
*B65D 21/028* (2006.01)
*B65D 21/024* (2006.01)
*B65D 88/02* (2006.01)
*B65D 21/02* (2006.01)

(52) U.S. Cl.
CPC ..... *B65D 88/027* (2013.01); *B65D 21/0204* (2013.01)
USPC ..... 220/23.4

(58) Field of Classification Search
CPC ..... B65D 21/0204; B65D 21/0202; B65D 21/02; B65D 88/027; B65D 88/022
USPC ..... 220/23.83, 23.4, 23.2, 567.2, 4.27, 220/23.86, 4.26, 565; 141/35; 248/298.1, 248/274.1; 206/0.6
IPC ..... B65D 21/028, 21/024
See application file for complete search history.

(56) References Cited

U.S. PATENT DOCUMENTS 2,483,038 A * 9/1949 Curtis ..... 24/288
2,812,099 A * 11/1957 Eugan ..... 220/23.4
3,631,974 A * 1/1972 Schaefer et al. ..... 206/0.6
3,823,973 A * 7/1974 Ramer ..... 294/68.26

FOREIGN PATENT DOCUMENTS

FR 2582036 A3 * 11/1986 ..... E04H 7/06

OTHER PUBLICATIONS

Translation of FR2582036 (Duthion), Nov. 21, 1986, p. 2.*

* cited by examiner

*Primary Examiner* — Robert J Hicks
(74) *Attorney, Agent, or Firm* — Matthew C. McCartney, Esq.; Gary L. Eastman, Esq.; Eastman & McCartney LLP

(57) ABSTRACT

A collective vertical tank has a plurality of tanks and stabilizing and weight-distributing connectors. The connectors are adjustable to provide an adjustable footprint of the collective tank. A stabilizing and weight-distributing connector for vertical hydraulic tanks includes a first connecting member attached to a first vertical tank and extending away therefrom, and a second connecting member attached to a second vertical tank and extending away therefrom. The second connecting member defines a central passage adapted to receive the first connecting member therein. A locking mechanism secures the first connecting member within the second connecting member.

6 Claims, 5 Drawing Sheets

COLLECTIVE VERTICAL HYDRAULIC TANK WITH ADJUSTABLE FOOTPRINT

RELATED APPLICATIONS

Not Applicable.

BACKGROUND OF THE INVENTION

1. Field of the Invention

The present invention relates to a collective vertical hydraulic tank with stabilizing connectors, the connectors adjustable to allow for an adjustable footprint for the collective tank.

2. Background

The use of fluids to facilitate drilling and extraction is well known in the oil and gas industry. Fluids commonly known as "drilling mud" provide a number of advantages when drilling a borehole. For example, drilling mud is used to carry cuttings produced by the drill bit to the surface through the annular space between the drill string and the wall of the borehole. Drilling mud can also transfer heat away from the drill bit and drilling assembly. Lubrication of the drill bit and assembly may also be provided, depending on the formulation of the drilling mud used. These and other functions are provided by drilling mud used during the drilling process.

In the process known as hydraulic fracturing, or fracking, a fracture is formed in a layer of rock by pumping fracturing fluid into a well bore at a rate sufficient to increase pressure downhole enough to fracture the rock. As the rock fractures, the fracturing fluid is pushed further into the rock, causing it to fracture further, and so on. This process can be used to release petroleum, natural gas, or other substances for extraction.

Fluid storage facilities are needed on-site to provide a store of fluid for applications such as hydraulic drilling and fracking. A variety of fluid storage tanks are known and used in the industry. Some such tanks are horizontal, including inflatable horizontal tanks that are easily transported to a job site. A drawback of horizontal tanks is that they occupy a great deal of space. As space at a job site becomes more valuable, it is preferably to use vertical tanks instead of horizontal ones.

Vertical tanks, however, suffer from drawbacks of their own. When using a vertical tank, the weight of the tank and the fluid included therein is spread over a much smaller area of ground than with a horizontal tank. Because of this, the impact of the tank on the ground is more substantial. Further, vertical tanks have greater instability than horizontal tanks, due in part to force vectors of fluid contained within the tank.

SUMMARY OF THE INVENTION

The present invention provides a collective vertical tank with stabilizing and weight-distributing connectors. The connectors are adjustable to provide an adjustable footprint for the collective tank. The stabilizing connectors include a first connecting member attached to a first vertical tank and extending away therefrom, and a second connecting member attached to a second vertical tank and extending away therefrom. The second connecting member defines a central passage adapted to receive the first connecting member therein. A locking mechanism secures the first connecting member within the second connecting member.

In one embodiment of the invention, the first connecting member is removably attached to the first vertical tank and the second connecting member is removably attached to the second vertical tank.

In another embodiment of the invention, the first connecting member defines a first plurality of openings along a length thereof and the second connecting member defines a second plurality of openings along a length thereof. A locking pin is inserted through the one of the first and one of the second plurality of openings locking the first and second connecting members when the connector is in use.

In another embodiment of the invention, the first connecting member is pivotably connected to the first vertical tank and the second connecting member is pivotably connected to the second vertical tank.

In another embodiment of the invention, a first connecting member has a first end and a second end. The first end of the first connecting member is attached to a first vertical tank and the second end of the first connecting member includes a first fastener. A second connecting member has first and second ends. The first end of the second connecting member is attached to a second vertical tank and the second end of the second connecting member includes a second fastener. The first and second fasteners are connectable.

In another embodiment of the invention, the first end of the first connecting member is pivotably attached to the first vertical tank and the first end of the second connecting member is pivotably attached to the second vertical tank.

In another embodiment of the invention, the first fastener is pivotably attached to the first connecting member and the second fastener is pivotably attached to the second connecting member.

In another embodiment of the invention, a connecting adapter is provided having a plurality of fasteners spaced around a perimeter thereof. The first fastener of the first connecting member is attached to a first of the plurality of fasteners spaced around the connecting adapter and the second fastener of the second connecting member is attached to a different one of the plurality of fasteners spaced around the connecting adapter. The connecting adapter is positioned between the first connecting member and the second connecting member.

In another embodiment of the invention, the connecting adapter includes a central support, a first connector attached to the perimeter of the central support, and a second connector attached to the perimeter of the central support. The first fastener of the first connecting member is attached to the first connector of the connecting adapter and the second fastener of the second connecting member is attached to the second connector of the connecting adapter.

In another embodiment of the invention, a third vertical hydraulic tank is provided. Third, fourth, fifth, and sixth connecting members are provided, each having first and second ends. The first end of the third connecting member is attached to the first vertical tank and the second end includes a fastener. The first end of the fourth connecting member is attached to the third vertical tank and the second end includes a fastener. The first end of the fifth connecting member is attached to the second vertical tank and the second end includes a fastener. The first end of the sixth connecting member is attached to the third vertical tank and the second end includes a fastener. The first and second connecting members are connected, the third and fourth connecting members are connected, and the fifth and sixth connecting members are connected such that the three vertical tanks are arranged in a triangular configuration.

Another embodiment of the invention provides a stabilized, weight-distributed system of vertical hydraulic tanks. The system includes a plurality of spaced-apart vertical hydraulic tanks and a plurality of stabilizing members attached to the vertical hydraulic tanks. Each vertical hydraulic tank is connected by a stabilizing member to at least one other vertical hydraulic tank.

In another embodiment of the invention, the stabilizing connecting members are adjustable in length.

In another embodiment of the invention, the stabilizing connecting members are pivotably attached to the vertical hydraulic tanks.

In another embodiment of the invention, the stabilizing connecting members are removably attached to the vertical hydraulic tanks.

In another embodiments of the invention, the spaced-apart vertical hydraulic tanks are arranged in a configuration selected from the group consisting of linear, triangular, quadrilateral, pentagonal, hexagonal, septagonal, and octagonal.

DETAILED DESCRIPTION OF THE INVENTION

Figure 1:
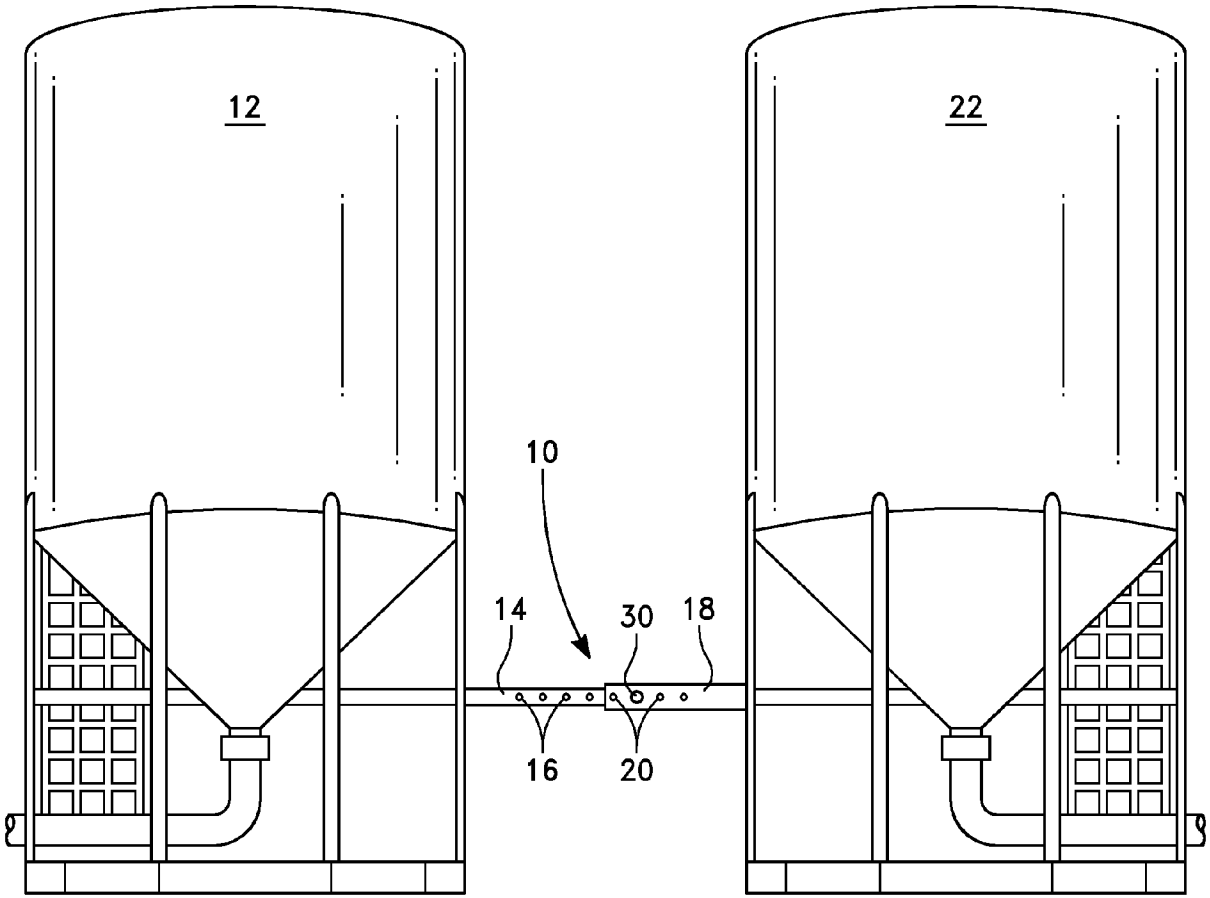
FIG. 1 is a perspective view of a two-tank collective vertical hydraulic tank of the present invention connected with one embodiment of a stabilizing, weight-distributing connector.
Figure 2:
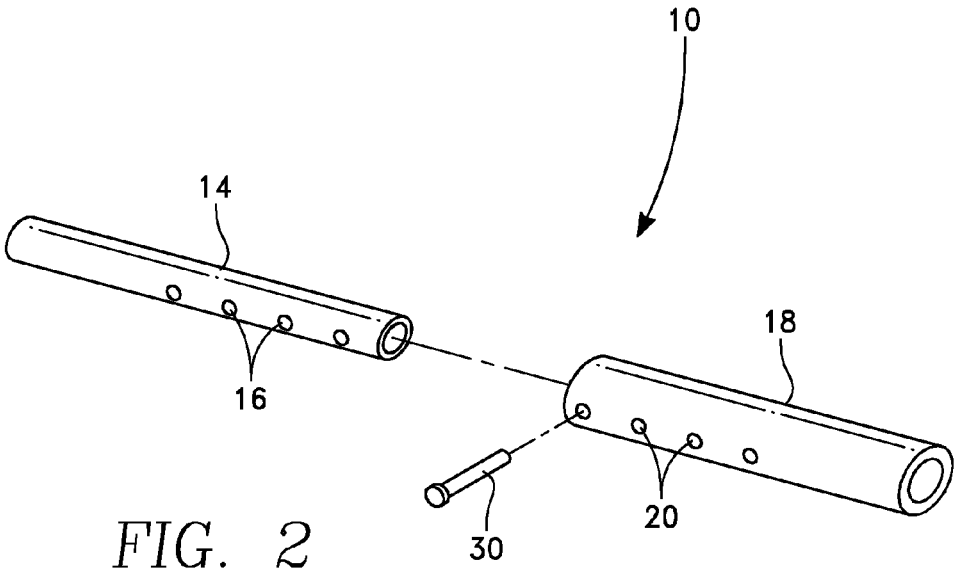
FIG. 2 provides an exploded view of the connector shown in FIG. 1 for connector two tanks of the present collective vertical tank. Two components of the connector are shown adapted to be mated to establish a connection.

The present invention provides a collective vertical hydraulic tank including two or more tanks connected by load distribution and stabilization connectors 10, which are adapted to connect a plurality of vertical tanks 12 as shown in FIG. 1. The stabilizing connectors 10 are adjustable in length so as to allow for an adjustable footprint of the collective vertical tank as a whole. In one embodiment, as shown in the Figure, a first vertical tank 12 includes a first connector 14, whereas a second vertical tank 22 includes a second connector 18. In the embodiment shown, first connector 14 is insertable into second connector 18 to varying depths depending on the desire of a user of the present invention. First connector 14 includes a plurality of openings 16 that may be aligned with a plurality of openings 20 in second connector 18. A pin 32 or other locking mechanism may be inserted through aligned openings to prevent disengagement of first connector 14 and second connector 18 once tanks 12 and 22 have been locked in place. FIG. 2 provides an exploded view of first connector 16 and second connector 18.

In another embodiment of the invention, the first and second connectors 14 and 18 are removably attached to the first and second vertical tanks 12 and 22, respectively. Any suitable fasteners or fastening mechanism may be used to secure first connector 14 to the first vertical tank 12 and second connector 18 to the second vertical tank 22. As shown in FIG. 2, for example, first vertical tank 12 may include a receiving attachment 24 for receiving first connector 14. Receiving attachment 24 includes an opening 28 therethrough, which can be aligned with an opening 32 in first connector 14. A pin 30 is inserted through openings 28 and 32, thereby securing first connector 14 in place. In this embodiment of the invention, second vertical tank 22 includes a second receiving attachment 26, which functions in the same manner as receiving attachment 24. It is contemplated that any suitable fastening or connecting mechanism may be used.

Receiving attachments 24 and 26 may also be pivotable, or may allow a pivotable connection of first connector 14 and second connector 18. For example, the connection between receiving attachments 24 and 26 and first and second connectors 14 and 18 may be of a ball-and-socket variety, with a pin or other fastener used to lock the connector in place when disposed at the desired angle. Alternatively, receiving attachments 24 and 26 or connectors 14 and 18 may be movable between discrete positions, extending at a variety of angles from the associated vertical tank. A variety of mechanisms for providing pivotable and positionable connections are known in the art, and it is contemplated that any such suitable mechanism may be used in conjunction with the present invention.

Figure 3:
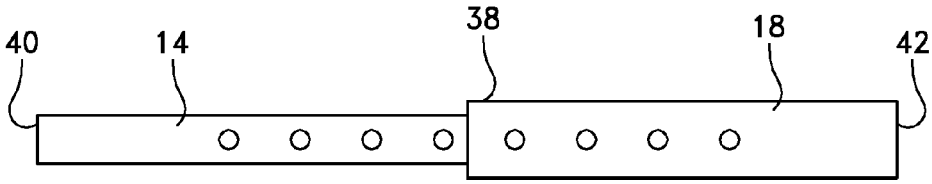
FIG. 3 is a perspective view of one alternative embodiment of a connector used with the collective vertical tank of the present invention, the connector including male and female ends.

As shown in FIG. 3, some embodiments of a connector 38 for use in a collective vertical tank of the present invention include a male connecting end 40 at one end of the connector 38 and a female connecting end 42 at the other end of the connector. In such embodiments, male connecting end 40 is adapted to be received by female connecting end 42 such that two or more connectors 38 may be attached in series. Such connectors 38 are useful in situations where due to the geometry or layout of the work site the distance between vertical tanks 12 is consistent and some vertical tanks 12 are located sufficiently far away from other vertical tanks 12 that simply including adjustable length connectors such as those described above with respect to FIG. 1 is insufficient to bridge the gap between some of the vertical towers 12. In such embodiments, the vertical tanks 12 include male and female connections so that either the male or female connecting ends on connectors 38 may be attached thereto. Preferably, the male or female connections on vertical tanks 12 are removably attached thereto such that a male connection may be replaced with a female connection, and vice versa, according to the needs on the job site.

Figure 4:
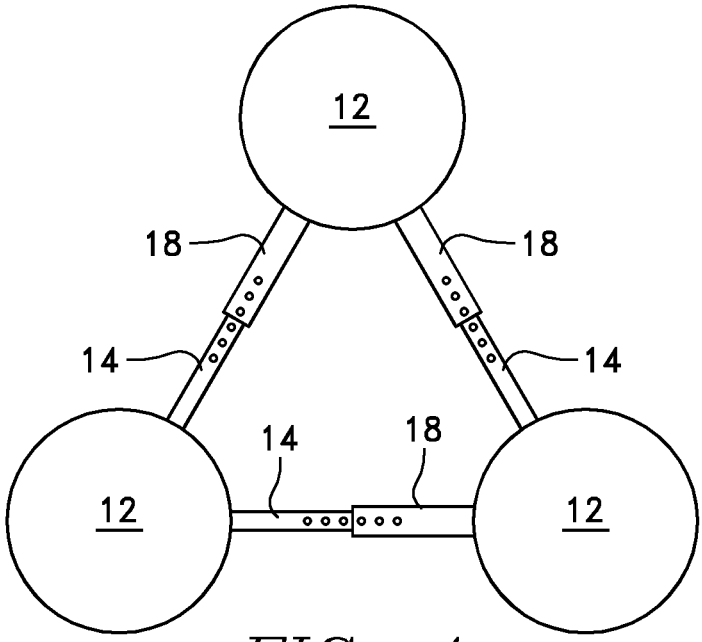
FIG. 4 is a top view of a three-tank embodiment of the collective vertical hydraulic tank of the present invention, the three tanks connected with connectors of the present invention and arranged in a triangular configuration.

Given that the connectors for use with the collective vertical tank of the present invention serve, in part, a stabilizing function, it should be noted that when a job site allows for it, certain geometric configurations provide the greatest stability. The pivoting nature of some of the connections described above allows vertical tanks 12 to be placed in a variety of geometric configurations. FIG. 4, for example, depicts a top view of three vertical tanks 12 arranged in a triangular configuration, which provides a great deal of stability as well as distributing the load amongst the three tanks. Each vertical tank 12 in this configuration is connected to two other vertical tanks 12. In the embodiment shown in FIG. 4, first and second connectors 16 and 18 are utilized as described with respect to FIG. 1. These connectors are pivotably attached to the respective vertical tanks. Further, it is preferred that the connectors are removably attached to the vertical tanks 12 so that the configuration of tanks may be changed if necessary or desired. Any of the above connectors used with the collective vertical tank of the present invention may be used with this configuration, including multiple connectors in series to bridge the gap between distant vertical tanks 12.

Figure 5:
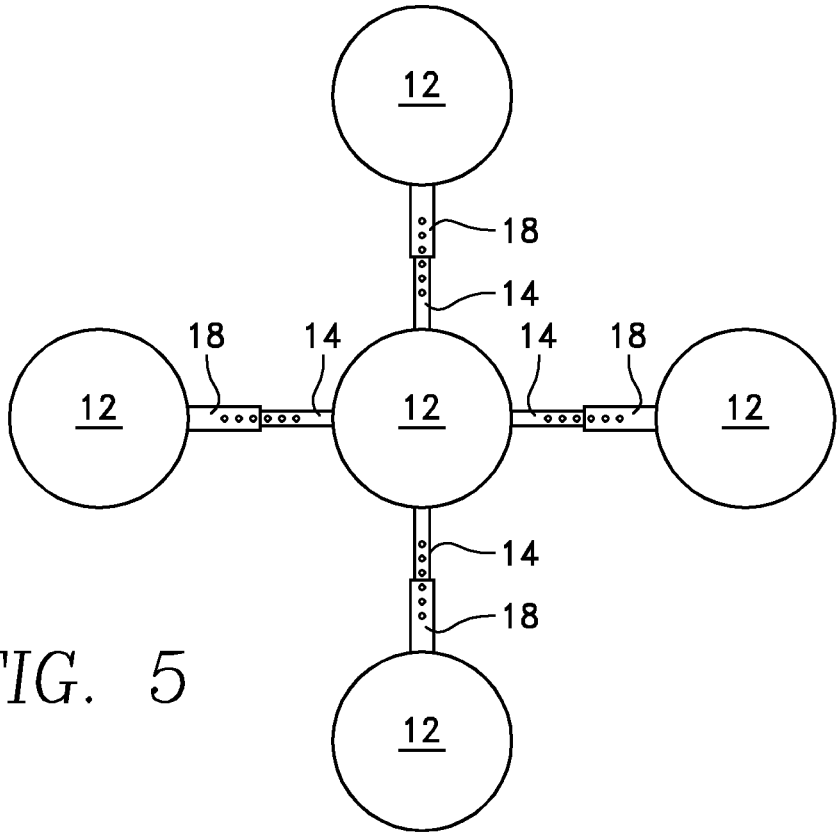
FIG. 5 is a top view of one alternative geometric configuration of vertical hydraulic tanks in a collective vertical tank of the present invention.

FIG. 5 shows an alternative configuration of vertical tanks 12 including a central vertical tank 12 having four evenly spaced vertical tanks around the perimeter thereof and attached thereto. In this configuration, the central vertical tank 12 is connected to each of the four other vertical tanks 12, while each of these 'satellite' vertical tanks 12 is connected only to the central vertical tank 12. Again, any of the variety of connectors, whether fixed, removable, stationary, or pivotable, may be utilized with this configuration.

Figure 6:
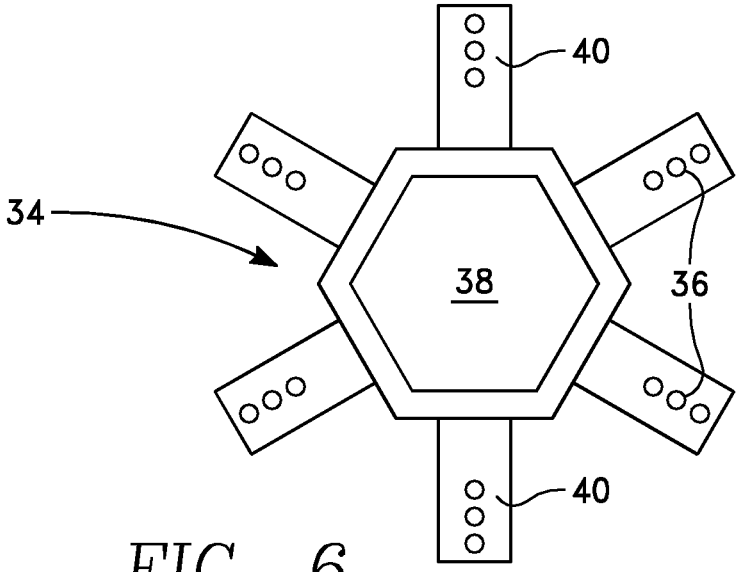
FIG. 6 is a perspective view of one embodiment of a connecting adapter for use with a collective vertical tank of the present invention.
Figure 7:
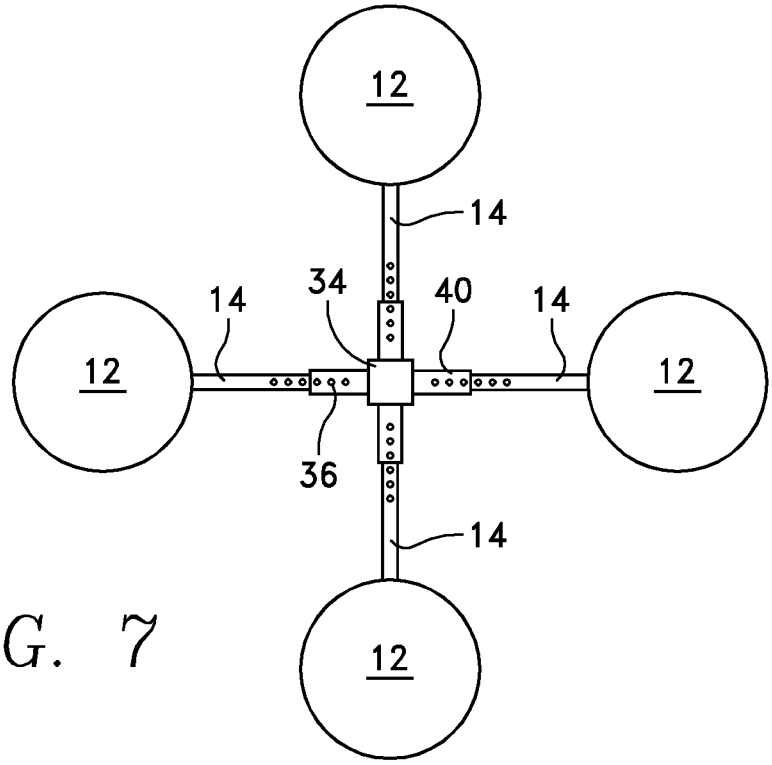
FIG. 7 is a top view of one configuration of a collective vertical hydraulic tank connected using connectors and a connecting adapter of the present invention.

In some situations wherein four or more vertical tanks 12 form a perimeter, as with the satellite vertical tanks in FIG. 5, there may be no ability to provide a central vertical tank 12 to which the others may be attached. In such situations, a connecting adapter 34 may be provided to form a center point of the connections between the vertical tanks 12. One embodiment of such a connecting adapter 34 is shown in FIG. 6. Connecting adapter 34 includes a central plate 38 having a plurality of radial connectors 40 disposed therearound. In the embodiment shown in FIG. 6, each of the plurality of radial connectors 40 includes an opening 36 through which a locking pin or other fastener may be inserted to lock a connector 38 thereto. Alternatively, connectors 18 or 16 may be used in conjunction with the connecting adapter 34. Any suitable fastener may be used to attach the various connectors to connecting adapter 34. FIG. 7 shows an exemplary embodiment of the present invention using connecting adapter 34. The figure shows four vertical tanks 12, shown from the top, each attached to central adapter 34 by connector 38. It is contemplated that central adapter 34 may be provided in a variety of shapes and configurations.

Figure 8:
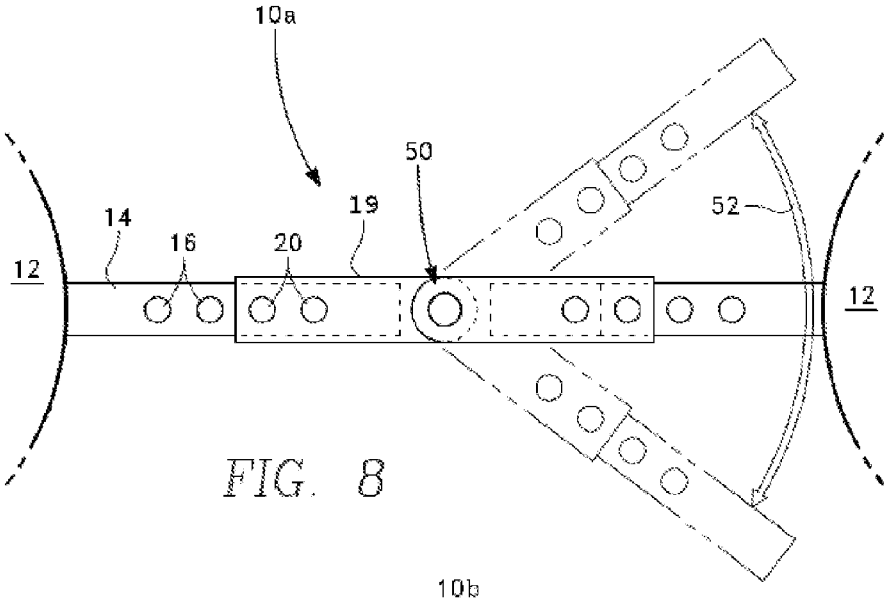
FIG. 8 is a perspective view of one embodiment of a pivotable connector for use with a collective vertical tank of the present invention, the pivot located near the center of the connector.

FIG. 8 shows one embodiment of a pivoting stabilizing connector 10*a* having a first pivotable connector 19 for use with a collective vertical tank of the present invention. As shown, first pivotable connector 19 includes pivot 50, a portion of the connector 19 being pivotable along path 52 around pivot 50. In the embodiment shown, pivot 50 is located near the center of first pivotable connector 19.

Figure 9:
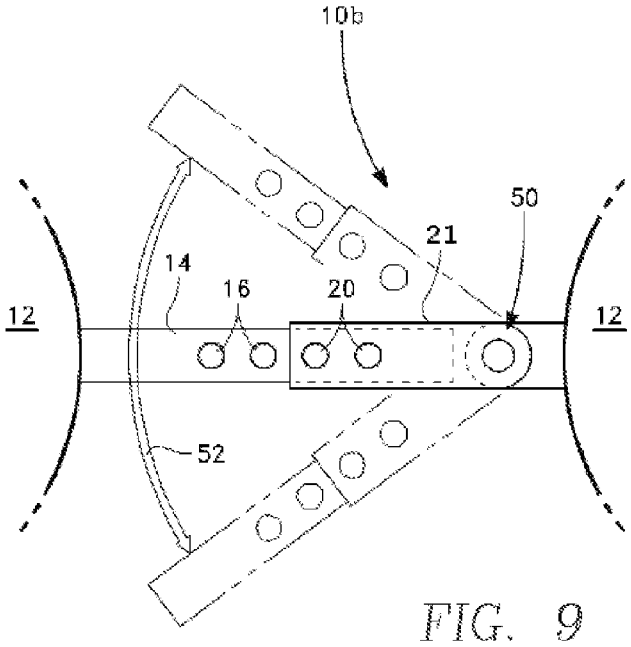
FIG. 9 is a perspective view of one embodiment of a pivotable connector for use with a collective vertical tank of the present invention, the pivot located near the tank.

FIG. 9 shows one embodiment of a pivoting stabilizing connector 10*b* having a first pivotable connector 21 for use with a collective vertical tank of the present invention. As shown, first pivotable connector 21 includes pivot 50, a portion of the connector 21 being pivotable along path 52 around pivot 50. In the embodiment shown, pivot 50 is located near the vertical tank, at one end of first pivotable connector 21.

It is understood that the foregoing description and the accompanying figures are exemplary of the shown and described embodiments of the present invention. Various modifications to the invention will be readily apparent to those of skill in the art upon reading this disclosure, and it is contemplated that such modifications remain within the spirit and scope of the invention.

Having thus described the preferred embodiment of the invention, what is claimed as new and desired to be protected by Letters Patent includes the following:

1. A collective vertical hydraulic tank with stabilizing connectors for an adjustable footprint comprising:

a first connecting member attached to a first vertical tank and extending away therefrom;

a second connecting member attached to a second vertical tank and extending away therefrom, the first vertical tank and the second vertical tank separated by a separation distance, the second connecting member defining a central passage and adapted to receive the first connecting member therein and insertable to varying depths to accommodate said separation distance; and a locking mechanism for securing the first connecting member within the second connecting member when the stabilizing connector is in use to maintain said separation distance.

2. The collective vertical hydraulic tank according to claim 1, wherein the first connecting member is removably attached to the first vertical tank and the second connecting member is removably attached to the second vertical tank.

3. The collective vertical hydraulic tank according to claim 1, wherein the first connecting member defines a first plurality of openings along a length thereof, and further wherein the second connecting member defines a second plurality of openings along a length thereof, further comprising a locking pin inserted through the first and second plurality of openings when the first and second plurality of openings are aligned, the locking pin locking the first connecting member to the second connecting member.

4. The collective vertical hydraulic tank according to claim 1, wherein the first connecting member is pivotably connected to the first vertical tank and the second connecting member is pivotably connected to the second vertical tank.

5. The stabilized, weight-distributed system of vertical hydraulic tanks of claim 1 wherein said plurality of stabilizing connecting members are adjustable in length.

6. The stabilized, weight-distributed system of vertical hydraulic tanks of claim 1 wherein said plurality of stabilizing connecting members are removably attached to said vertical hydraulic tanks.

* * * * *